US005628574A

United States Patent [19]

Crowley

[11] Patent Number: 5,628,574

[45] Date of Patent: May 13, 1997

[54] WEB ERROR RECOVERY DIVERT SYSTEM

[75] Inventor: H. W. Crowley, Eliot, Me.

[73] Assignee: Roll Systems, Inc., Burlington, Mass.

[21] Appl. No.: 616,513

[22] Filed: Mar. 19, 1996

[51] Int. Cl.[6] ..... B41J 11/26

[52] U.S. Cl. ..... 400/621; 101/227; 101/484; 400/74; 400/708; 226/2; 226/4; 226/27; 226/45; 250/559.05; 250/559.06; 250/559.44; 250/557

[58] Field of Search ..... 400/621, 74, 708; 101/483, 484, 181, 226, 227, 248, 93, 93.61; 226/2, 8, 9, 24, 27, 45; 250/559.04, 559.05, 559.06, 559.07, 559.29, 559.44, 557

[56] References Cited

U.S. PATENT DOCUMENTS

| | | | |
|---|---|---|---|
| 3,958,270 | 5/1976 | Graniere et al. | 101/93 |
| 4,166,541 | 9/1979 | Smith, Jr. | 250/563 |
| 4,318,176 | 3/1982 | Stratton et al. | 101/248 |
| 4,366,753 | 1/1983 | Glanz et al. | 101/181 |
| 4,485,982 | 12/1984 | St. John et al. | 226/15 |
| 4,607,572 | 8/1986 | Pou et al. | 400/708 |
| 4,669,344 | 6/1987 | Herrig | 83/27 |
| 4,700,627 | 10/1987 | Hagler | 101/181 |
| 4,835,720 | 5/1989 | Ditto et al. | 101/226 |
| 4,843,959 | 7/1989 | Rendell | 101/93.01 |
| 4,858,123 | 8/1989 | Alexoff et al. | 364/412 |
| 4,865,872 | 9/1989 | Pellatiro | 427/9 |
| 4,922,337 | 5/1990 | Hunt et al. | 250/572 |
| 4,926,048 | 5/1990 | Lerner et al. | 226/2 |
| 4,951,223 | 8/1990 | Wales | 101/248 |
| 5,043,904 | 8/1991 | Sikes et al. | 101/248 |
| 5,187,376 | 2/1993 | Hashimoto et al. | 250/562 |
| 5,193,727 | 3/1993 | Crowley | 226/24 |

*Primary Examiner*—Eugene H. Eickholt
*Attorney, Agent, or Firm*—Cesari and McKenna

[57] ABSTRACT

A web error recovery divert system is provided. A web is printed and scanned for errors. An error is identified in a grouping of sections or pages. A replacement grouping of sections or pages is printed. The replacement grouping includes an identifying mark or banner page indicating the presence of a replacement section. The web is redirected through a cutter and diverter that identifies the banner page and, at the appropriate locations, cuts and removes the grouping having the error. The replacement grouping and the remainder of the web is driven to a post-processing unit for further operations.

11 Claims, 7 Drawing Sheets

WEB ERROR RECOVERY DIVERT SYSTEM

FIELD OF THE INVENTION

This invention relates to an automatic error recovery divert system and more particularly for a system that eliminates sections of a printed web in which errors have been identified without the time-consuming process of locating specific sections having such errors.

BACKGROUND OF INVENTION

Quality control is an essential part of high-volume printing processes. Despite ever-increasing reliability of print engines and other web processing devices, it is not uncommon for errors to occur on a section of a long printed web. In production, a continuous web of printable material is processed in a single run and, typically, at a later time the web is separated into sheets for further processing and sorted. In such high volume operations, it is often difficult to identify individual errors on the web.

A typical scan of a web for errors involves either a manual or automated inspection of the web at predetermined intervals. The web is sometimes slowed or stopped to allow visual inspection. Most scanning equipment is incapable of adequately checking the web at high speed and, thus, error checking is usually performed only at intervals.

When an operator or an automated mechanism locates an error at a given interval, a reprint must be performed to replace the damaged web section (typically one or more "pages"). At this time, the operator must decide how many pages to replace. The operator must use a judgment in determining how much of the web requires reprinting. One disadvantage to this technique of error checking is that it requires a decision on the part of the operator as to the number of sheets to replace. In addition, the damaged section must be tracked, thenceforth, as part a larger continuous web, to insure that it is eliminated when the web is rewound onto a receiving roll, or is processed in a post-production operation. In substance, the manual location of erroneous web sections is time-consuming, imprecise and requires substantially tracking technology that increases the risk of unreliable printing.

It is, therefore, an object of this invention to provide a system that detects errors in a web and provides a quick and effective solution for eliminating errors without employing complex tracking techniques. The system should generate minimal waste of usable web sections and should enable accurate reproduction of eliminated web sections so that the total desired volume of the print run is achieved.

SUMMARY OF INVENTION

A web error recovery divert system according to this invention overcomes the disadvantages of the prior art in that it identifies groupings of sections or pages having an error on at least one of the sections or pages and replaces the grouping with an error-free replacement grouping, while discarding the grouping having the error. This avoids the need of having to track a single page throughout the printing process.

The system according to one embodiment of this invention includes a source of web having processing in the form of printing or other enhancements thereon. The web can be divided into groupings of sections or pages. A scanner is used to identify errors in at least one of the groupings. This scanner can comprise a human operator. A controller responds to the scan and instructs reprocessing of a grouping of web having the error thereon. An identifier is placed on the reprocessed grouping. This identifier can comprise a banner page or marking on the grouping. A cutter and gate mechanism are provided to cut and divert the grouping of the web having the error and the drive mechanism directs the remaining web and the reprocessed grouping to a post-processing location. A collection bin or other waste container can be used to store erroneous groupings. The web can be collected at various points and re-fed to further processing devices using rolls.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
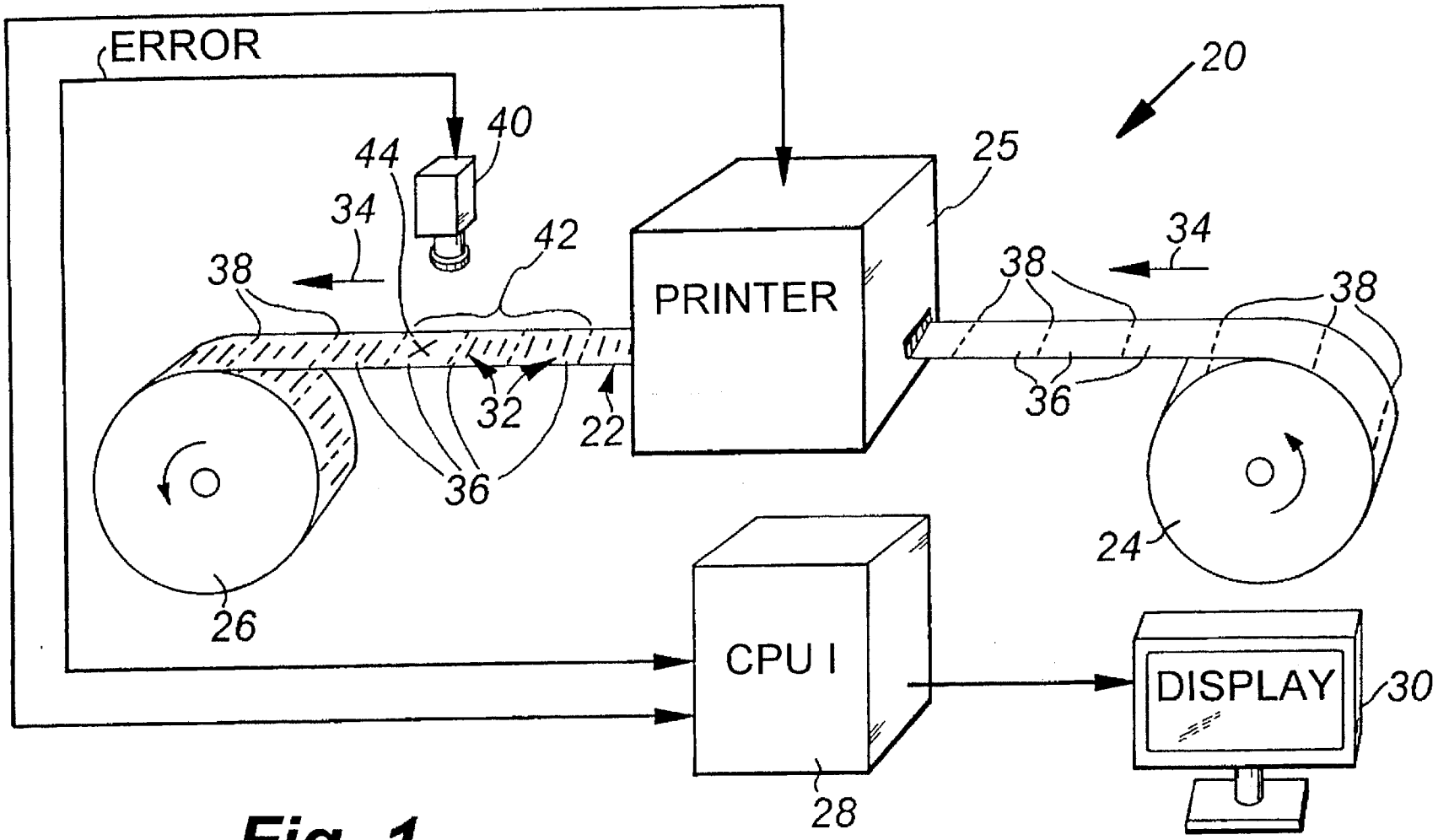
FIG. 1 is a schematic perspective view of a web error recover divert system according to this invention showing the identification of an error in a printing web.

An error recovery divert system is shown schematically in FIGS. 1–7. The system 20 is utilized to scan for errors on a roll of web 22 as it is unwound from a first roll 24, passed through a printer 25 and rewound on a second roll 26. Any acceptable roll stand arrangement can be used. Likewise, any acceptable driving mechanism can be used to wind and unwind the rolls and to direct them through the printer 25.

The printer 25 can comprise any acceptable programmable printer, such as a laser printer, typically designed for high-volume operation on a continuous web. The printer 25 receives instructions from a CPU 28 that can be located within the housing of the printer or can be provided off site. The CPU can include a display console 30 and an input device (not shown) to control operation of the printer.

The printer 25 lays down text 32 on each sheet as it exits the printer 25, moving in the downstream direction (arrows 34). The text, or other printed signs or symbols, can comprise any form of information according to this invention. Typically, printing 32 is provided to the web 22 in discrete blocks, in the form of pages or sections. The sections 36 according to this embodiment, are separated by page breaks shown by dotted lines 38. The page breaks 38 can comprise pre-cut perforations or, alternatively, can be unseen breaks at points that are acted upon by a cutter, as described further below.

As the printed sections 36 of the web pass out of the printer 25, they pass under a scanner 40, that can comprise an optical scanner programmed to recognize a printed pattern according to a program within the CPU 28. The scanner can look for predetermined text, or can be programmed to scan for major printing errors such as blotches or missed print. It can also be programmed to scan for misaligned sections of print.

It is contemplated that the scanner 40 of this invention can be replaced with human scanning, Alternatively, a human-monitored camera can be used on the line. The web error recovery divert system according to this invention will operate effectively with all forms of web inspection.

It is generally contemplated that web inspection will occur at intervals along the web 22. In other words, an inspection sample will be taken for each grouping of a plurality of sections 36. As detailed in FIG. 1, a relatively small grouping 42 of sections 36 is scanned. It is common that a much larger number section such as one hundred sections (or pages) can be substituted in a practical embodiment. However, for the purposes of this explanation, a grouping of three sections or pages is described.

Figure 2:
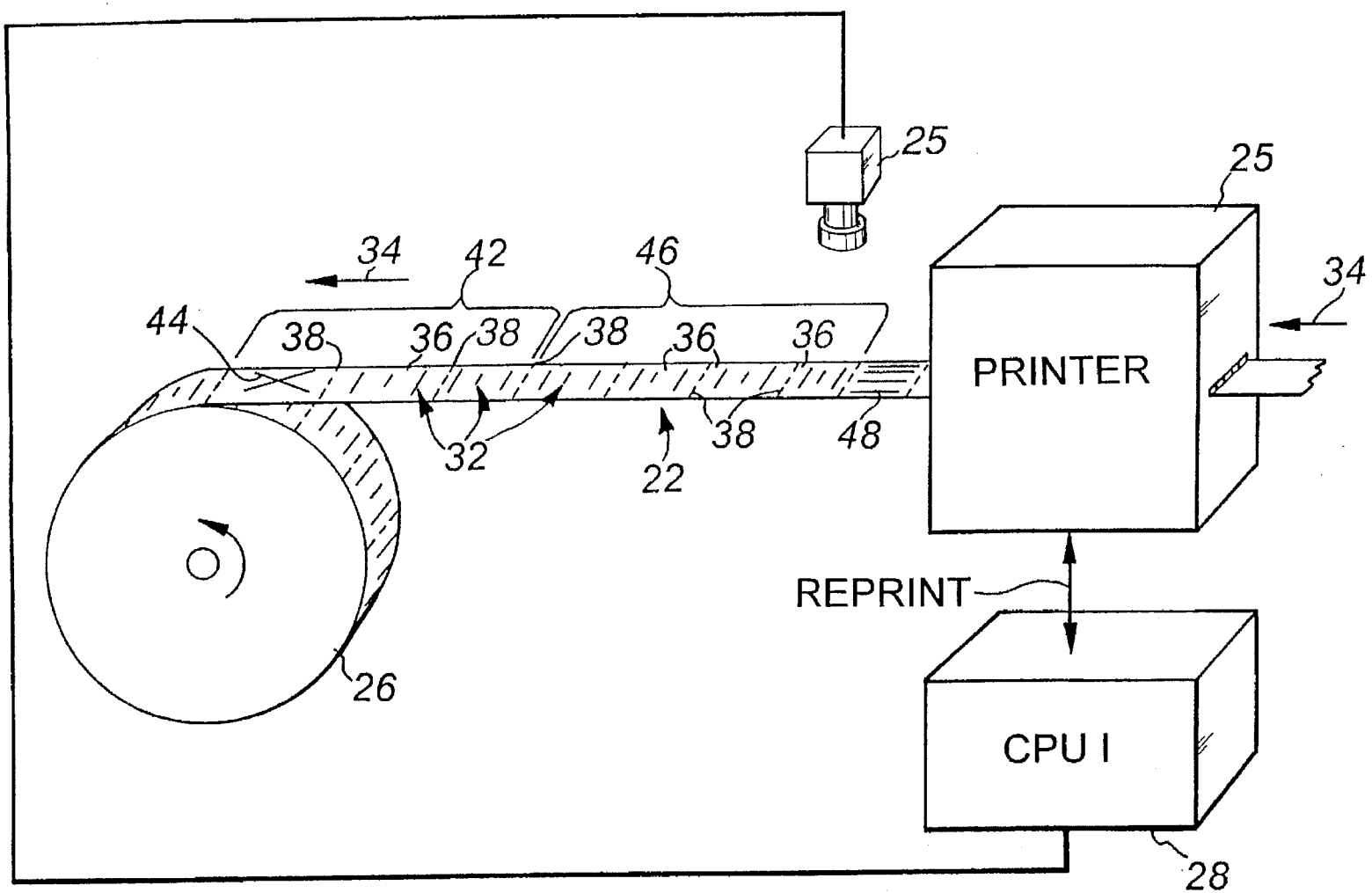
FIG. 2 is a partial schematic perspective view of the error recovery divert system of FIG. 1 showing a reprint operation based upon identification of an error on the web.

An erroneous page 44 designated with a large "X" is located by the scanner 40. As noted above the "scanner" can be a human operator who notes an erroneous page and identifies it as the section passes by his or her view. As the erroneous section 44 is identified, an ERROR SIGNAL is sent to the CPU 28. The CPU 28 responds as shown in FIG. 2 by generating a REPRINT SIGNAL to the printer 25. The printer 25 responds by reprinting a new grouping 46 of pages identical to the original grouping that included the error. Note that grouping size and location 22 can be determined ahead of time by a counting routine transferred between the CPU and printer. Thus, the erroneous page 24 can be located anywhere within a given grouping of pages or sections. By identifying an erroneous page somewhere within a particular grouping, the entire grouping is marked for replacement. The printer 25 responds by reprinting a complete copy of the grouping 42 as a new replacement grouping 46. This replacement grouping 46 is located upstream of the original erroneous grouping 42. It can be directly adjacent, as shown in FIG. 2, or can be located at a more remote upstream position in the web 22, depending in part upon how quickly a reprint signal can be transferred to the printer and acted upon. For example, if an erroneous page is located near the end of a predetermined grouping, then there may not be time to generate a reprint signal before the next grouping is done. In this instance, the replacement grouping 46 would be placed in the next grouping after a grouping directly adjacent the erroneous grouping 42. The CPU uses a program to track whether the replacement 46 is directly adjacent the erroneous grouping 42 or further upstream. At the end of the replacement grouping 46, the printer provides a banner section 48. The banner section 48 can be narrow, or the same size as other pages or sections 36 in the web. The banner section 48 include a code or text that specifically identifies the existence and location of a replacement grouping 46 and can include information about the location and size of an erroneous grouping 42 on the web 22. A conventional bar code can be used to convey such information or an OCR-scannable code can be utilized.

Tracking of sections of web as they pass to and from the operational elements of the system of this invention can be accomplished using a variety of techniques. One acceptable technique is disclosed in U.S. Pat. No. 5,193,727 to Crowley, the teachings of which are expressly incorporated herein by reference.

After the replacement grouping 46 and banner page 48 pass through the printer 25, it continues to print further groupings in accordance with the regularly programmed printer run, The scanner 25 continues to scan for errors at this time.

Figure 3:
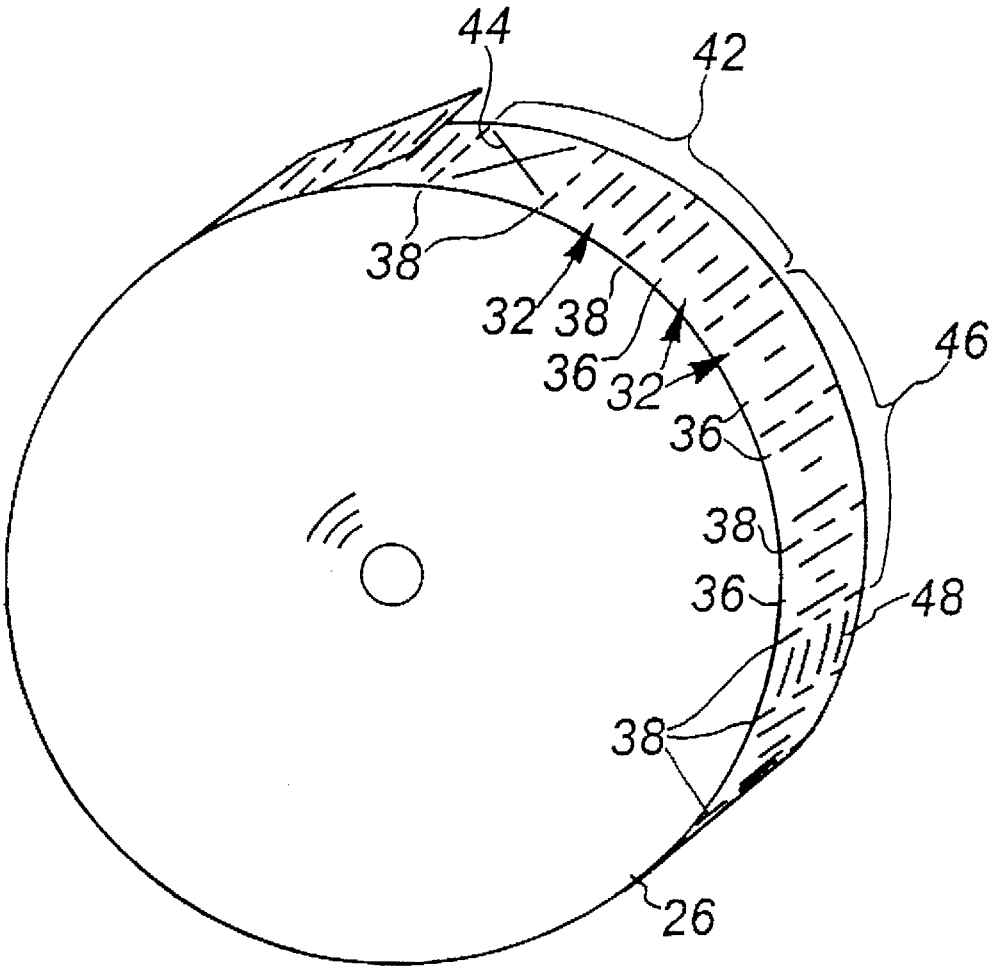
FIG. 3 is a schematic perspective view of a completed roll of printed web including the web section having the error and a reprinted web section according to this invention.
Figure 4:
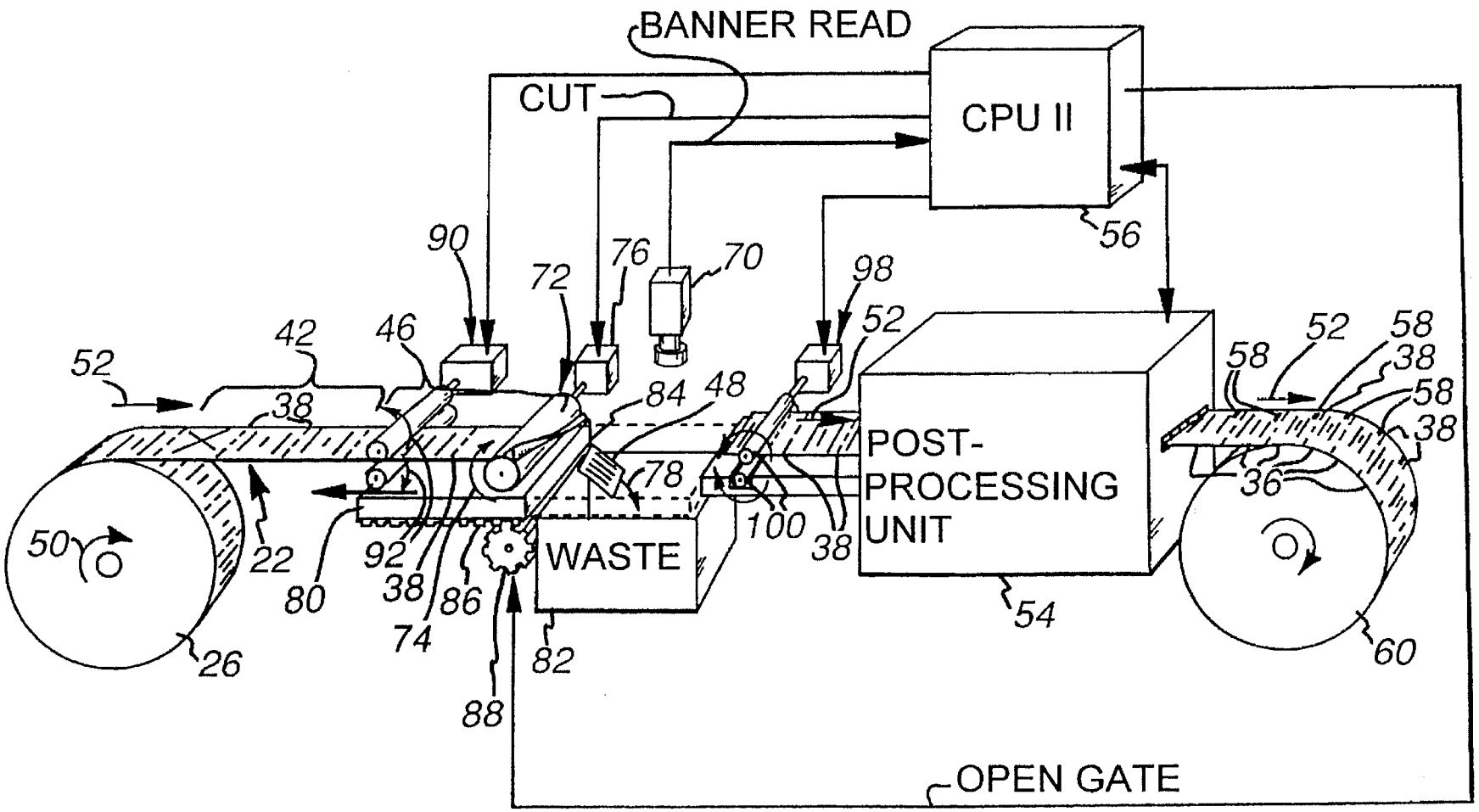
FIG. 4 is a schematic perspective view of the error recovery divert system according to this invention showing an initial diversion of a portion of the reprinted web into a waste bin.

As shown in FIG. 3, when the print run ends, it is contained on the roll 26. The roll 26 in this embodiment includes the erroneous page or section 44 and its corresponding erroneous grouping 42, along with the replacement grouping 46 and the identifying banner, page 46. As detailed in if FIG. 4, the completed roll of printed web 26 is again unwound (curved arrow 50) in a second downstream direction (arrows 52) toward a post-processing unit 54. The post-processing unit 54 can be any device that performs further production processes on the web 22. Such post-processing units can include folders, page separators, embossers, further printers or enveloping devices. This list of post-processing devices is meant be taken only by example and any acceptable post contemplated. The post-processing unit 54 receives instructions from a CPU. The post-processing unit 54 performs a post-processing operation shown schematically as a dot 58 on each output web section 36. In FIGS. 3 and 4, the output web, sections 35 having post-processing operations proposed hereon are wound into a finished roll 60. Rerolling is only one possible collection technique. The web can also be separated by the post-processing device or by a further downstream device, and it cab be output as finished sheets divided, typically, along section breaks 38.

As the printed web 26 is unrolled from the roll 26, the replacement grouping 46 and the erroneous grouping 42 become exposed. The first portion of the replacement and erroneous groupings 46 and 42, respectively, to arrive at a downstream position is the banner page 48. As detailed in FIG. 4, a scanner 70 reads the banner page 48 and instructs the CPU with a BANNER READ signal that can include information regarding the location and size of the replacement and erroneous groupings. The exact location of the scanner 70 is partially dependent upon how quickly the mechanism can react to the identification of the banner page. In most embodiments, the scanner would be located a few sections downstream of the post-processing unit so that appropriate action be taken by the mechanism prior to passage of the banner page 48 and replacement and erroneous groupings 46 and 42 respectively, into the post-processing unit.

In response to receipt of a BANNER READ signal, the CPU 56 issues a cut signal to a cutter 72 positioned a predetermined location. The cutter 72 in this embodiment comprises a rotary cutter that rotates (arrow 74) based upon a drive 76 to cut the web at a desired location. In this embodiment, the desired location is a page or section break 38. At the same time the cutter separates the downstream edge 78 of the banner page from the succeeding downstream web, a door or hatch 80 is opened to reveal a waste bin 82. It should be clear to one of ordinary skill that a variety of hatchways, and diversion systems, can be used according to this invention. The hatchway is opened by an OPEN GATE signal also issued by the CPU. At approximately the same time, the upstream edge 84 of the banner page is also cut and the banner page is released into the waste bin 82. It may be necessary to slow the web or to run it intermittently during this process. Note that the gate 80 is operated by a rack 86 and corresponding pinion 88 that is in communication with the CPU 56. An auxiliary drive mechanism 90 with corresponding drive rollers 92 is utilized according to this invention at the upstream location of the web so that the separated web continues to be directed downstream (arrows 52). A similar drive 98 with rollers 100 is provided downstream of the wastebin 82 adjacent the post-processing unit 54. Hence, a separation in the web by the cutter 72 does not affect movement of the web. The drives 90 and 98 operate in conjunction with the post-processing unit based upon commands delivered by the CPU 56.

Figure 5:
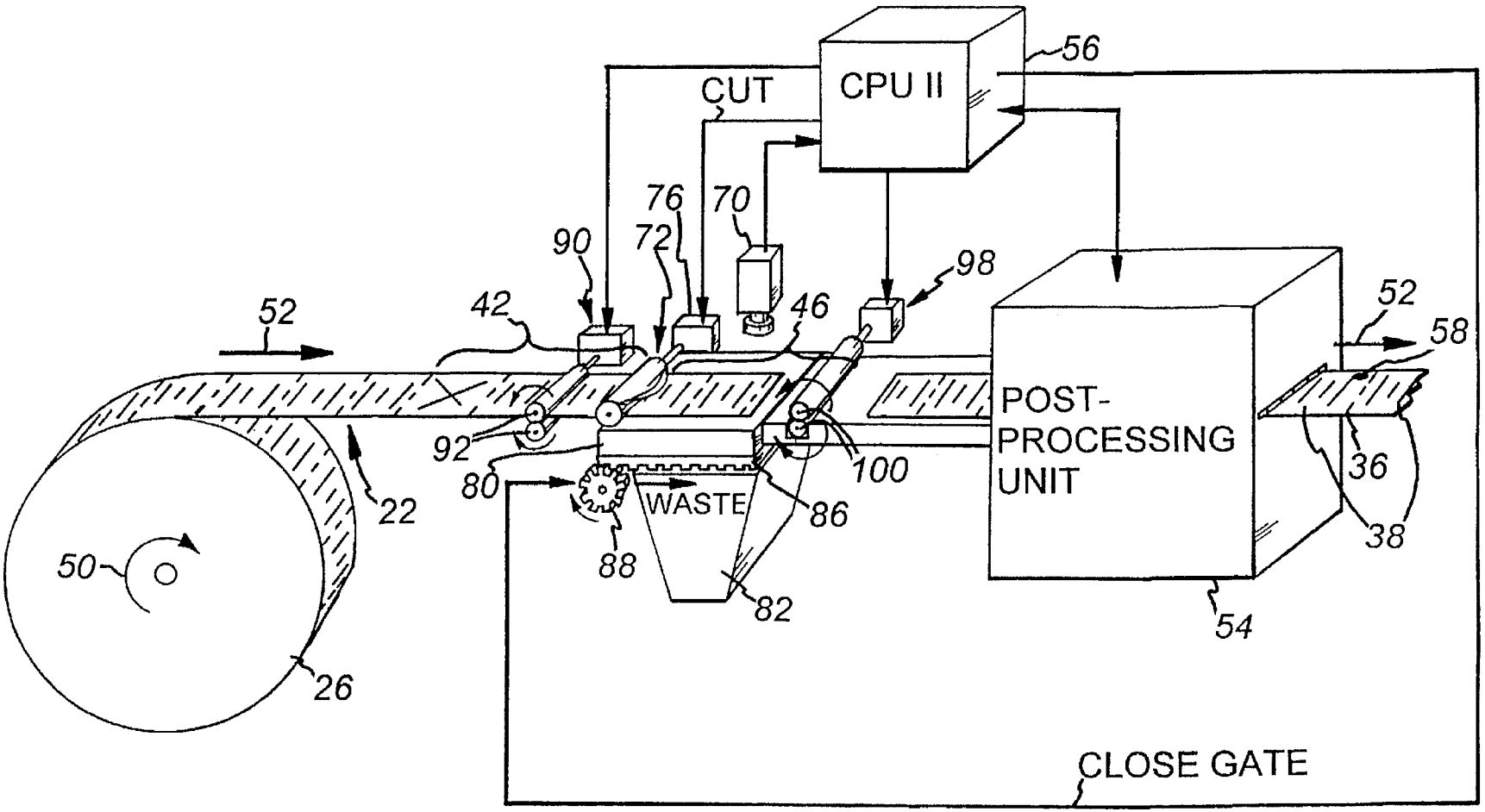
FIG. 5 is a schematic perspective view of the web error recovery divert system according to this invention showing the routing of the separated reprinted section.
Figure 6:
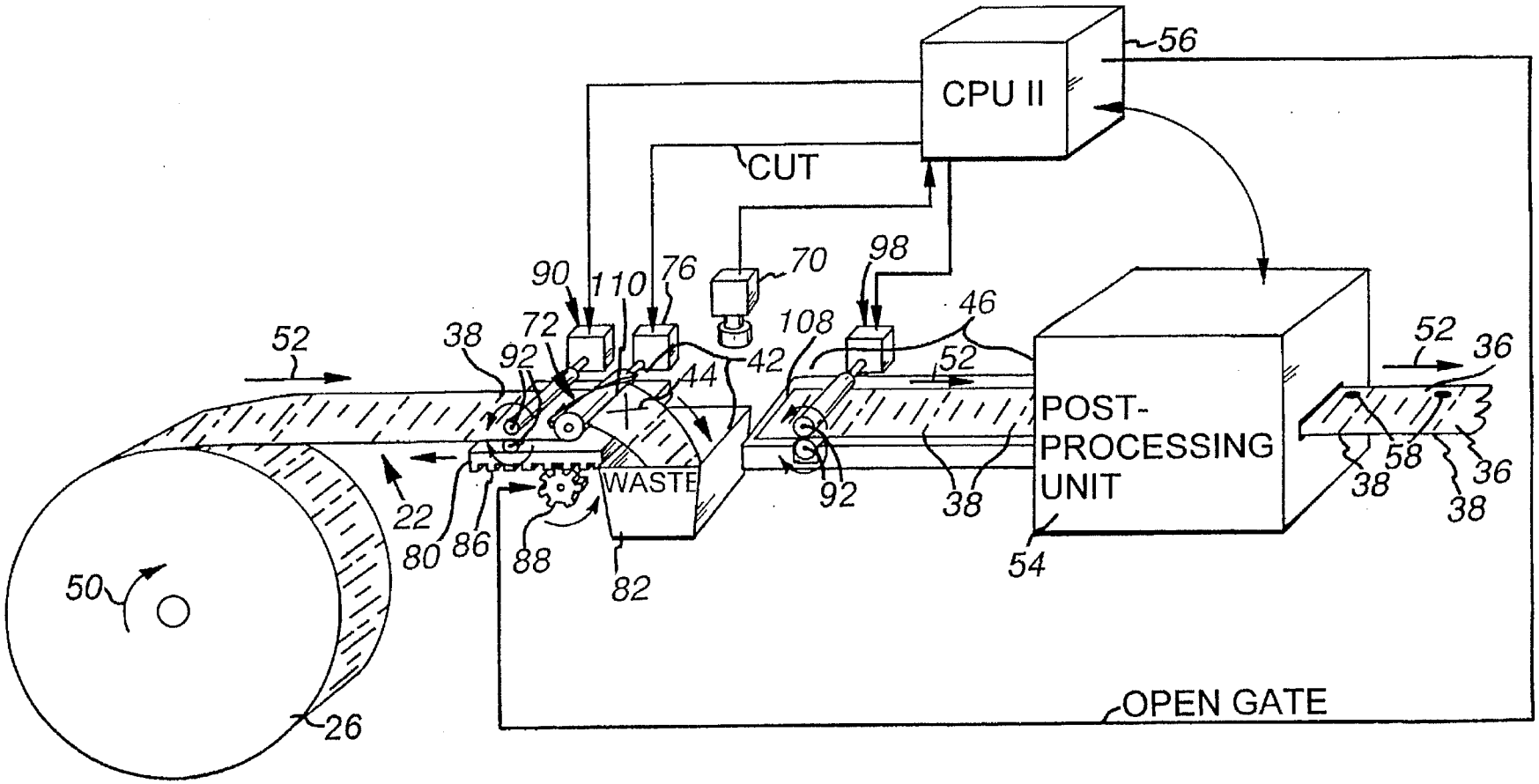
FIG. 6 is a schematic perspective view of the web error recovery divert system according to this invention showing the diversion of the web section having the error into a waste bin.
Figure 7:
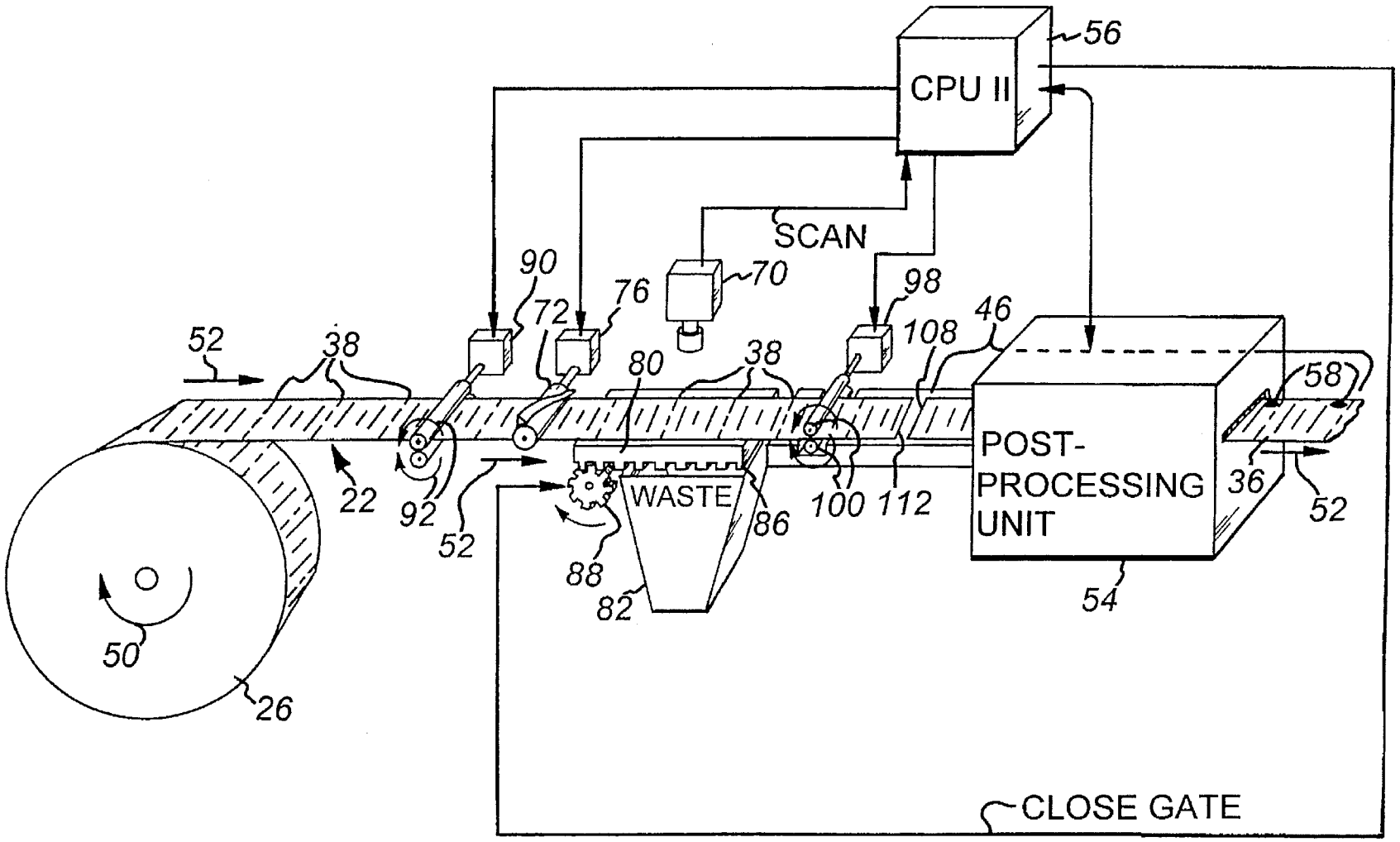
FIG. 7 is a schematic perspective view of the web error recovery divert system according to this invention showing the routing of the upstream portion of the web following the diversion of the section having the error.

With further reference to FIG. 5, once the banner page 48 is disposed of in the wastebin 82, the CPU 56 issues an immediate CLOSE GATE signal to the gate drive 88. The gate 80 is closed to allow the replacement grouping 46 to pass into the downstream drive rollers 100 and thence into the post-processing unit 54. When the auxiliary drives 90 and 98 have advanced the replacement section 46 beyond the cutter 72, the CPU, which tracks the progress of the rollers 90 and 98 and compares progress to a known distance of the replacement grouping 46, issues another cut signal as shown. The cut signal directs the cutter drive 76 to cause the cutter blade 70 to cut the upstream edge of the replacement grouping 46 and separate it from the adjacent erroneous grouping 42. As noted above, the replacement grouping 46 continues on into the post-processing unit 54 under power of the downstream auxiliary drive 98. Note, that if a web grouping is sufficiently long that it will be engaged by the post-processing unit 54 before the upstream edge is cut, then it may be possible to omit at least one or both of the auxiliary drive units 90 and 98.

As the replacement grouping 46 passes away from the gate 80, with its upstream edge 108 separated from the erroneous grouping 42, the CPU 56 issues another OPEN GATE and the erroneous grouping 42 is directed into the waste bin 82. The CPU also issues a cut signal to sever the upstream edge 110 of the erroneous grouping from the remaining web. As detailed in FIG. 7, the gate 80 is again closed by a CLOSE GATE signal issues by the CPU 56 as the remaining upstream web with upstream most edge 112 passes into the downstream auxiliary drive 98. As detailed, the replacement grouping 46 has passed into the post-processing unit 54. The erroneous grouping 42 resides in the wastebin 82. The scanner 70 is activated and transmits a scan signal to the CPU 56 to continue searching for further banner pages, indicative of replacement and erroneous groupings of sections. As noted above, the scan process can be performed automatically, or can be handled manually by an operator who has a possibility of visual inspection. If manual, the operator would be relied upon to deliver the error signal to the CPU instructing elimination of the erroneous section and isolation of the replacement section by removal of the banner page.

Note that in some embodiments, the banner page can be omitted and the information can be provided on a normal page or section. In such an instance, only one separating process as detailed in FIGS. 6 and 7, would occur. The separating process would remove the erroneous grouping only.

The foregoing has been a detailed description of a preferred embodiment. Various modifications and additions can be made without the spirit and scope of this invention. For example, further sets of drive members and drive rollers can be utilized along sections of the web where positive driving is desired. The CPU can be part of any of the devices that act upon the web or can be a separate controller. Accordingly, this description is meant to be taken only by way of example and not to otherwise limit the scope of the invention.

What is claimed is:

1. An error recovery divert system comprising:

a source of web having processing thereon, the web being divided into groupings of sections;

a scanner that identifies errors in each of the groupings of sections;

a controller, responsive to the scanner, that instructs reprocessing of a grouping of the web having the error thereon;

an identifier that locates a reprocessed grouping;

a cutter and gate mechanism constructed and arranged to operate in response to the identifier that cuts and diverts the grouping of the web having the error; and a drive mechanism that directs each of the web and the reprocessed grouping to a post-processing location.

2. The web error recovery divert system as set forth in claim 1 wherein the identifier includes a banner page and a scanner for reading the banner page, the banner page being located at an end of the reprocessed grouping.

3. The web error recovery divert system as set forth in claim 2 further comprising a waste container for receiving the grouping of the web having the error from the cutter and the gate mechanism.

4. The web error recovery divert system as set forth in claim 1 further comprising a printer that applies printing to the web and that responds to the controller to print the reprocessed grouping of web.

5. A method for web error recovery diversion comprising the steps of:

directing a web through a printer that applies print to sections of the web;

scanning the web from the printer for an error in at least one of the sections;

identifying an error and instructing reprinting of a grouping of web having the error;

reprinting the replacement grouping of sections of web identical to the grouping having the section with the error including providing an identifying mark to the replacement grouping;

collecting the web having each of the grouping having the error and the grouping at a collection point into a collected web;

re-feeding the collected web to a cutter and divert system including scanning the web for the identifying mark, directing the replacement grouping through the cutter free of cutting and operating the cutter to remove the grouping of web having the error; and directing each of the replacement grouping and a portion of the web to a post-processing unit.

6. The method as set forth in claim 5 wherein the step of providing the identifying mark includes providing a banner page adjacent an end of the replacement grouping.

7. The method as set forth in claim 5 further comprising providing a roll stand for forming the web into a roll at the collection point.

8. The method as set forth in claim 5 wherein each of the grouping having the section with the error and the replacement grouping includes a plurality of sections.

9. The method as set forth in claim 5 wherein the step of printing the identifying mark includes locating the identifying mark at a downstream most position on the replacement grouping.

10. The method as set forth in claim 5 further comprising reading the identifying mark to determine the size and location of the grouping having the section with the error on the web.

11. A web error recovery divert system comprising:

a source roll of web;

a printer for applying printing to a web in sections;

a scanner that scans each of the sections of web for errors;

a controller that identifies a discrete grouping of sections of web having an error and instructs the printer to print an identical grouping of sections of web free of errors subsequent to location of an error, the identical replacement grouping including an identifying mark indicating presence of replacement grouping;

another scanner that scans web having printing thereon for presence of the identifying mark;

a cutter and gate mechanism that, in response to scanning of the identifier mark remove the grouping having the error; and a drive mechanism that enables the remaining web including the replacement grouping to pass through a collection source.

* * * * *